US005207025A

United States Patent [19]

Westfall

[11] Patent Number: 5,207,025

[45] Date of Patent: May 4, 1993

[54] AUTOMATIC FRICTION SHOE

[75] Inventor: Norman R. Westfall, Rochester, N.Y.

[73] Assignee: Caldwell Manufacturing Company, Rochester, N.Y.

[21] Appl. No.: 950,937

[22] Filed: Sep. 24, 1992

[51] Int. Cl.[5] ..... E05F 1/00

[52] U.S. Cl. ..... 49/445; 49/430

[58] Field of Search ..... 49/445, 446, 430, 429, 49/181, 176

[56] References Cited

U.S. PATENT DOCUMENTS

| | | | |
|---|---|---|---|
| 2,796,630 | 6/1957 | Haas . | |
| 2,933,757 | 4/1960 | Almendinger . | |
| 2,952,048 | 9/1960 | Graham . | |
| 3,466,806 | 9/1969 | Teggelaar et al. | 49/445 |
| 4,078,336 | 3/1978 | Prosser | 49/445 |
| 4,190,930 | 3/1980 | Prosser | 49/445 X |
| 4,570,382 | 2/1986 | Suess . | |
| 4,763,447 | 8/1988 | Haltof et al. . | |
| 4,779,380 | 10/1988 | Westfall . | |
| 5,033,235 | 7/1991 | Stark . | |
| 5,036,622 | 8/1991 | Stark . | |
| 5,117,586 | 6/1992 | Stark . | |

FOREIGN PATENT DOCUMENTS 723420 12/1965 Canada .

OTHER PUBLICATIONS

E-Z Lift Window Channels advertisement sheet.

Caldwell Manufacturing Company engineering drawings Nos. 22R04, 22R05, and 22R06.

*Primary Examiner*—Philip C. Kannan

*Attorney, Agent, or Firm*—Eugene Stephens & Associates

[57] ABSTRACT

A sash platform for an automatic friction shoe connects to the shoe by means of a curved arm that fits into a correspondingly curved recess molded into the shoe body. An abutment limits the insertion of the curved arm into the shoe and holds a sash support blade at an operating level, and a curved holder surface supports the platform against the downward force of a sash. The shoe connects to a spring or counterbalance element and runs frictionally in a jamb liner channel.

31 Claims, 2 Drawing Sheets

AUTOMATIC FRICTION SHOE

FIELD OF THE INVENTION

This invention involves an automatic friction shoe for a counterbalance system for a window sash.

BACKGROUND

Automatic friction shoes have long been desirable for window sash counterbalance systems. This is because the spring forces used in most counterbalance systems vary with the position of the sash, while the weight of the sash remains fixed, resulting in overbalance and underbalance at some sash positions. This would cause hop or drop, except for the resistance of the frictional forces involved. Of these, the friction between the sash and the jamb liner is generally constant, but the friction of the counterbalance system itself can be varied. This has led to the recognition of automatically variable friction produced by the counterbalance shoes, which interconnect the sash and the counterbalance system. The automatic variation of this friction is preferably responsive to the counterbalance forces and the sash weight, to produce more friction for heavier sashes and stronger counterbalances.

Automatic shoe friction can be produced in many ways, but a common preference is to take advantage of the offset that normally exists between the upward force of a counterbalance element applied to the shoe and the downward force of the weight of a sash applied to a platform extending out from the shoe. Since these upward and downward forces are ordinarily offset from each other, they produce a moment arm that tilts or torques the shoe so that upper and lower surfaces of the shoe rub frictionally against inside surfaces of the jamb liner channel in which the shoe runs. The automatic friction produced by this can be adjusted by the length of the offset moment arm, the vertical height of the shoe, the materials used for the shoe body and the jamb liner channel, and the configuration of the shoe surfaces rubbing against the jamb liner.

The prior art contains many variations applying these operating principles to automatic friction shoes, and two recent examples (U.S. Pat. Nos. 5,036,622 and 5,117,586) are relevant for suggesting that the sash platforms for such frictional balance shoes can be as simple as bent wires. These suffer some disadvantages, though, including pivoting of the wire from vertical, which can cause it to rub against the side of the slot in the jamb liner, and related problems involving mounting the wire reliably on the shoe body so that it affords a secure grip on the supported sash. This invention improves on the sash platform, to solve the problems encountered by bent wire sash platforms, and to accomplish all the functions necessary to an automatic friction shoe, effectively and reliably at a low cost.

SUMMARY OF THE INVENTION

This invention provides a better form of sash platform connected in a new way to the body of an automatic friction shoe that runs vertically in a jamb liner channel. The shoe is connected to a counterbalance element, and the platform extends from the shoe through a slot in the jamb liner channel to engage and support a sash. A portion of the platform connected to the shoe has a curved arm insertable into a correspondingly curved recess in the shoe. The shoe has a holding surface engaging the inside of the curved arm and an abutment surface limiting downward movement of an outwardly extending portion, which is preferably in the form of a sash-supporting blade. Such an arrangement allows quick, easy, and reliable assembly of the platform to the shoe; keeps the platform from pivoting or moving laterally relative to the shoe; and allows both the platform and a preferably molded resin shoe to be formed economically to meet all the necessary functions, including frictionally rubbing the shoe in its jamb liner channel.

DRAWINGS

DETAILED DESCRIPTION

Figure 1:
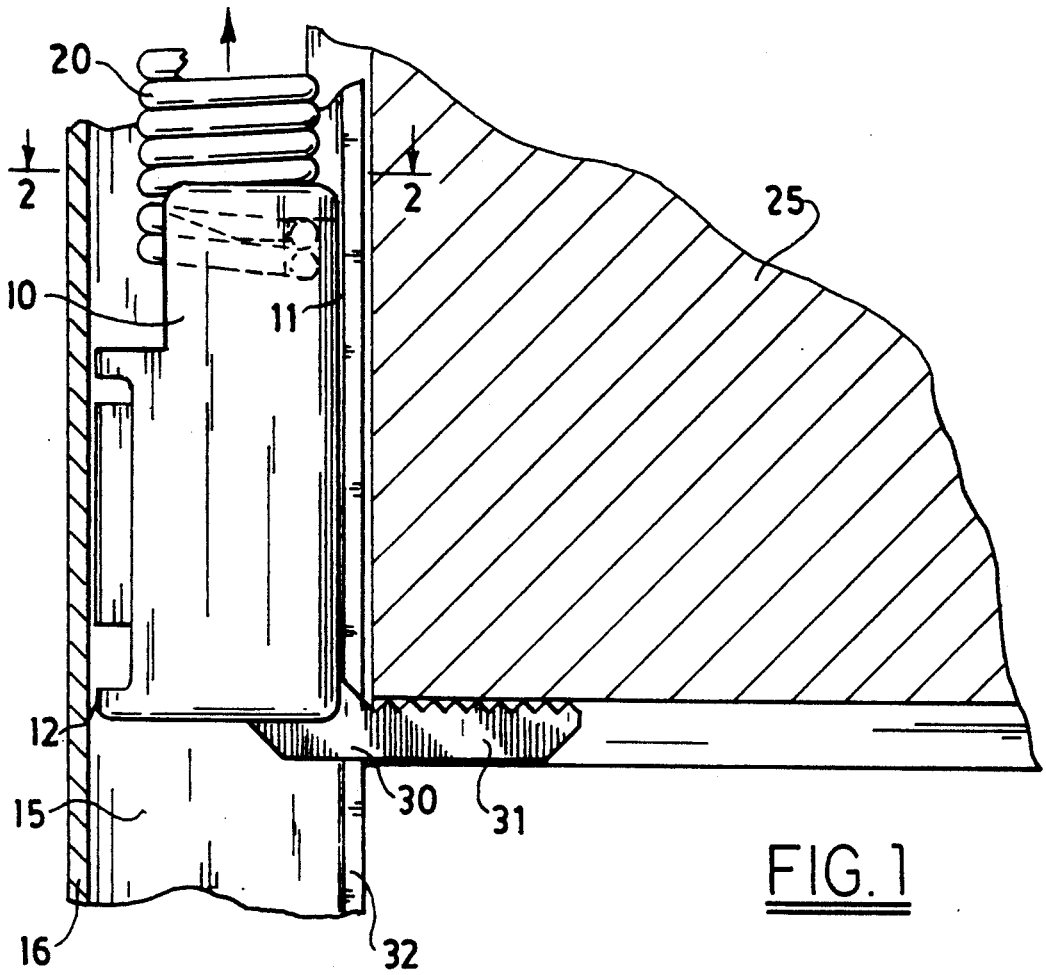
FIG. 1 is a partially cutaway, partially schematic view of a preferred embodiment of the inventive shoe and platform supporting a sash, a fragment of a lower corner of which is shown.
Figure 2:
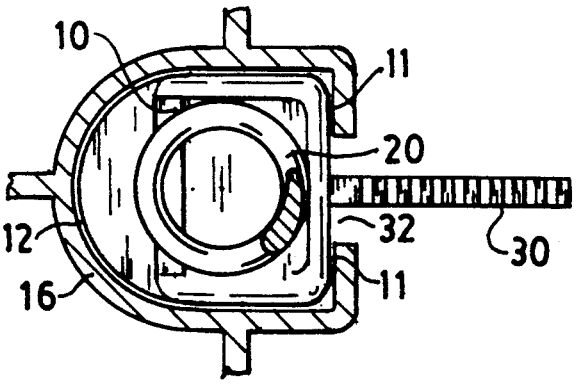
FIG. 2 is a cross-sectional view of the shoe of FIG. 1, taken along the line 2—2 thereof, which is drawn to exclude the sash.
Figure 3:
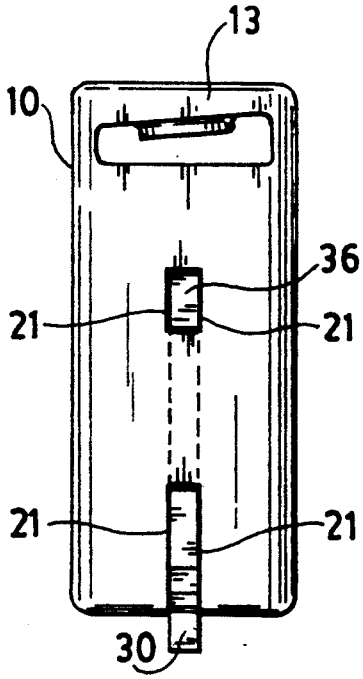
FIG. 3 is a front-elevational view of the shoe and platform of FIG. 1 and 2.
Figure 4:
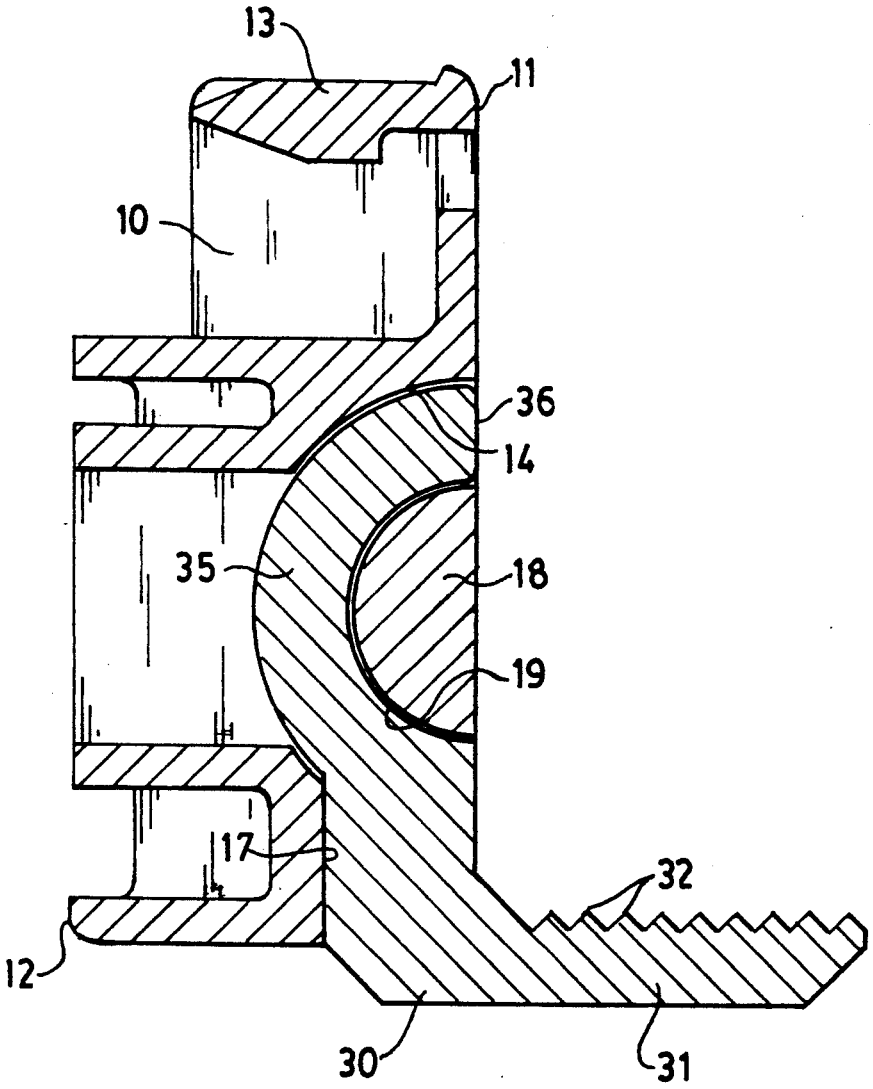
FIG. 4 is a cross-sectional view of the shoe and platform of FIGS. 1-3, taken along a vertical plane.

A preferred embodiment of sash shoe 10 is shown schematically in FIGS. 1 and 2 in an operating position in jamb liner channel 15 and is shown in structural detail in FIGS. 3 and 4. The operating environment, as best shown in FIG. 1, is well understood. It includes a spring 20, or other counterbalance element, exerting an upward force on shoe 10 within jamb liner channel 15, while a lower corner of a sash 25 rests on platform 30 where it produces a downward force. The offset between the downward force on platform 30 and the upward force exerted by counterbalance spring 20 torques shoe 10 so that an upper surface 11 and a lower surface 12 rub against the inside surfaces of a wall 16 of jamb liner channel 15. This produces the desired frictional force, which automatically varies as a function of spring force and sash weight, to prevent hop or drop of sash 25.

Shoe 10 is preferably molded of resin material and has a connector 13 for engaging counterbalance spring 20. Connector 13 can have many different forms, but is preferably an intercoil spring connector molded into top region of body 10, as best shown in FIGS. 3 and 4.

The improvement of this invention involves a platform 30 and its interconnection with shoe 10. This is arranged to meet all the requirements of a counterbalance shoe, including low cost, automatic frictional effect, a reliable connection to spring 20, and a reliable support for sash 25. The preferred structure of the improved platform 30 is shown in the drawings.

The sash support portion of platform 30 is preferably a blade 31 having one or more teeth 32 oriented upward to engage an underside of a lower corner of sash 25. Especially for a wooden sash 25, teeth 32 bite into the lower sash rail and help support sash 25 securely on blade or arm The connection of platform 30 to shoe 10 occurs through a connector arm 35 that is preferably formed integrally with sash blade 31. Arm 35 is curved along an arc having a center of curvature on the sash side of shoe 10, and a correspondingly curved recess 14 is formed in shoe 10 to receive arm 35. The curvature of arm 35 allows a free end 36 of arm 35 to be inserted into recess 14 and to follow along the curvature of recess 14 until arm 35 is completely housed within recess 14, as illustrated. At this point, an abutment 17 in a lower region of shoe 10, adjacent curved recess 14, engages platform 30, limiting its further insertion into shoe 10 and limiting downward movement of sash blade 31 below horizontal. At the same time, arm holder 18 having a curved surface 19 engages the radially inner side of curved arm 35 to hold platform 30 against any downward movement. Lateral vertical sides 21 of recess 14 extend on opposite sides of platform 30 and hold platform 30 in vertical alignment within shoe 10. This prevents any lateral movement or turning of platform 30 relative to shoe 10 and ensures that sash support blade 31 extends straight out from shoe 10 in the desired orientation to support sash 25. The free, upper end 36 of connector arm 35 extends to the front or sash side of shoe 10 where an opening exists to facilitate molding of recess 14.

Shoe 10, including the curved shape of recess 14, is formed to be moldable of resin material. This is accomplished by mold parts entering the sash side of the body of shoe 10 above and below holder 18 and entering the back side of shoe 10 in a region opposite holder 18.

Upper front edge 11 and lower rear edge 12 of shoe body 10 are preferably radiused for frictionally engaging wall 16 of jamb liner channel 15. The rear of shoe 10 and lower rear edge 12 are curved to fit a corresponding curve in jamb liner channel wall 16. In effect, this gives shoe 10 a stable, three-zone frictional engagement with jamb liner channel 15, at upper surface 11 extending on opposite sides of a slot 32 for sash blade 31 and at a curved lower rear region 12.

Platform 30 is quickly and easily assembled to shoe 10, simply by hooking curved arm 35 into recess 14 and sliding arm 35 as far as possible into shoe 10. An interference fit preferably holds platform 30 in a fully assembled position in shoe 10, as illustrated. Spring 20 also connects readily to shoe 10, simply by sliding connector 13 between coils of spring 20. The engagement of arm 35 against curved holder 18 and abutment 17 holds platform 30 securely in operating position. This provides a reliable support for sash 25 and is also effective at torquing shoe 10, for automatic friction purposes. Platform 30 cannot slip out of position, turn aside, or be misassembled in any way. Also, shoe 10 and platform 30 are both formed at low cost so that the improvement in their reliability can be provided at a competitive price.

I claim:

1. In a window sash friction shoe connectable to a counterbalance element for running vertically in a jamb liner channel to support a sash on a platform having a connector portion mounted within a recess of said shoe and a sash support portion extending from said shoe through a slot in said jamb liner channel, the improvement comprising:

a. said connector portion of said platform having an arm curved around a point located on a sash side of said arm;

b. said shoe having an arm holder surface bordering said recess for engaging a radially inside surface of said curved arm; and c. said shoe having an abutment surface engaging a side of said connector portion opposite to said arm holder surface.

2. The improvement of claim 1 wherein said recess opens at a bottom region of said shoe.

3. The improvement of claim 2 wherein said abutment surface engages said connector portion below said curved arm and is located adjacent said open bottom region of said recess.

4. The improvement of claim 1 wherein lateral sides of said recess are bounded by parallel vertical walls.

5. The improvement of claim 1 wherein said recess has a top opening on a sash side of said shoe.

6. The improvement of claim 5 wherein an upper end of said curved arm extends to said top opening.

7. The improvement of claim 1 wherein an intercoil spring connector is arranged in an upper region of said shoe.

8. The improvement of claim 1 wherein a lower rear region of said shoe is configured for frictionally engaging a surface of said jamb liner channel.

9. The improvement of claim 8 wherein said surface of said jamb liner channel and said lower rear region of said shoe are curved.

10. The improvement of claim 1 wherein an upper surface of said sash support portion of said platform has an upwardly oriented tooth.

11. The improvement of claim 1 wherein said shoe and said recess in said shoe are molded of resin material.

12. In a sash friction shoe connected to a counterbalance element and having an offset sash platform creating a moment arm between the downward force on said platform of the weight of said sash and the upward force on said shoe of said counterbalance element, for torquing said shoe frictionally in a jamb liner channel in which said shoe runs, the improvement comprising:

a. said platform having a connector with a curved arm insertable into a correspondingly curved recess of said shoe, for holding said platform on said shoe;

b. the curvature of said connector arm and said recess being arranged so that downward force on said platform torquing said shoe frictionally in said jamb liner channel also urges said connector arm into said recess; and c. an abutment arranged on a lower region of said shoe for limiting downward movement of said platform.

13. The improvement of claim 12 wherein said shoe has a holding surface engaging said curved connector arm on a sash side of said arm.

14. The improvement of claim 12 wherein said recess opens at a bottom region of said shoe adjacent said abutment.

15. The improvement of claim 12 wherein said recess has an open top on a sash side of said shoe, and an upper end of said connector arm extends to said open top of said recess.

16. The improvement of claim 12 wherein a center of curvature of said connector arm is arranged on a sash side of said connector arm.

17. The improvement of claim 12 wherein lateral sides of said recess are vertical and parallel to hold said platform against lateral movement relative to said shoe.

18. The improvement of claim 12 wherein an upper surface of said platform has an upwardly oriented tooth for engaging a lower corner of said sash.

19. The improvement of claim 12 wherein said shoe is molded of resin material, and said platform is formed of metal material.

20. The improvement of claim 12 wherein an upper region of said shoe has an intercoil spring connector.

21. The improvement of claim 12 wherein a rear surface of said shoe opposite said platform is configured for frictionally engaging a vertical wall of said jamb liner channel.

22. The improvement of claim 21 wherein said rear surface of said shoe and said surface of said jamb liner channel are curved.

23. A two-piece sash shoe having a resin body connected to a counterbalance element and slideable in a jamb liner channel and a sash platform connected to said body and extending from said body through a slot in said jamb liner channel to engage and support a lower corner of a sash, said sash shoe comprising:

a. a sash support blade of said platform extending from a bottom region of said shoe, and a curved connector arm of said platform extending upward into a recess molded in said shoe;

b. an abutment surface of said recess engaging said platform in a position limiting downward movement of said sash support blade;

c. a holding surface of said recess engaging a radially inner surface of said curved connector arm of said platform to hold said platform in an operating position on said shoe; and d. said recess being formed with openings on a front side of said shoe facing said sash and on a rear side of said shoe opposite said sash.

24. The sash shoe of claim 23 wherein said recess has a top opening on said front side of said shoe, and said curved connector arm extends to said top opening.

25. The sash shoe of claim 23 wherein a rear side opening of said recess is arranged opposite said curved holding surface.

26. The sash shoe of claim 23 wherein a lower rear surface of said shoe is configured for frictionally engaging a vertical wall of said jamb liner channel.

27. The sash shoe of claim 26 wherein the lower rear friction surface of said shoe and the vertical wall of said jamb liner channel engaged by said friction surface are curved.

28. The sash shoe of claim 23 wherein an upper region of said sash has an intercoil spring connector.

29. The sash shoe of claim 23 wherein opposed vertical side walls of said recess engage side surfaces of said platform to prevent lateral movement of said platform.

30. The sash shoe of claim 23 wherein said sash support blade has a toothed upper surface.

31. The sash shoe of claim 23 wherein downward force on said sash support blade, opposed by upward counterbalance force on said body, torques said body into frictional engagement with said jamb liner channel.

* * * * *